United States Patent [19]

Smith

[11] 4,136,659

[45] Jan. 30, 1979

[54] CAPACITOR DISCHARGE IGNITION SYSTEM

[76] Inventor: Harold J. Smith, 4642 Hanna St., Fort Wayne, Ind. 46806

[21] Appl. No.: 629,996

[22] Filed: Nov. 7, 1975

[51] Int. Cl.[2] ..... F02P 3/08

[52] U.S. Cl. ..... 123/148 E; 123/148 CB; 315/209 CD

[58] Field of Search ..... 123/148 E, 148 CA, 148 CB, 123/148 CC; 315/209 CD

[56] References Cited

U.S. PATENT DOCUMENTS

| | | | |
|---|---|---|---|
| 3,312,860 | 4/1967 | Strum | 123/148 CB |
| 3,357,415 | 12/1967 | Huntzinger | 123/148 CA |
| 3,381,172 | 4/1968 | Weiner | 123/148 CB |
| 3,448,732 | 6/1969 | Weiss | 123/148 CB |
| 3,644,818 | 2/1972 | Paget | 315/209 CD |
| 3,677,253 | 7/1972 | Oishi et al. | 123/148 CB |
| 3,704,699 | 12/1972 | Howard | 123/148 CB |
| 3,714,507 | 1/1973 | Schweitzer et al. | 123/148 CB |
| 3,828,751 | 8/1974 | Adams | 123/148 E |
| 3,841,287 | 10/1974 | Nielsen | 123/148 CB |
| 3,842,816 | 10/1974 | Vargas | 123/148 CB |
| 3,842,817 | 10/1974 | Mallory | 123/148 CC |
| 3,861,372 | 1/1975 | Shibukawa et al. | 123/148 CC |
| 3,903,861 | 9/1975 | Di Cecco et al. | 123/148 CB |
| 3,961,617 | 6/1976 | Satake | 123/148 CB |

FOREIGN PATENT DOCUMENTS

| | | | |
|---|---|---|---|
| 1916091 | 10/1970 | Fed. Rep. of Germany | 123/148 CB |
| 1201410 | 8/1970 | United Kingdom | 123/148 CB |

*Primary Examiner*—Charles J. Myhre
*Assistant Examiner*—Andrew M. Dolinar
*Attorney, Agent, or Firm*—Gust, Irish, Jeffers & Rickert

[57] ABSTRACT

A capacitor discharge ignition system including a DC to AC inverter circuit for converting a battery voltage to high voltage AC, and a rectifier for rectifying the high voltage to DC. A power capacitor and the primary winding of the ignition coil are serially coupled across the output of the rectifier. A silicon controlled rectifier is also coupled across the output of the rectifier and has its trigger element coupled to a trigger circuit which provides a trigger signal to turn on the silicon controlled rectifier in response to opening of breaker points thus causing the power capacitor to discharge through the primary winding of the ignition coil thereby to provide the requisite high voltage in the secondary winding to provide the spark at the respective spark plug. A ring capacitor is coupled across the primary winding of the ignition coil and is proportioned to provide a damped oscillatory current in the primary winding when the silicon controlled rectifier is turned off thereby limiting the rate of flux decay by clamping or ringing-out the remaining flux thus effectively clamping the secondary winding to a limited peak output voltage so as to inhibit misfiring.

14 Claims, 11 Drawing Figures

CAPACITOR DISCHARGE IGNITION SYSTEM

BACKGROUND OF THE INVENTION

1. Field of the Invention

This invention relates generally to capacitor discharge ignition systems for internal combustion engines.

2. Description of the Prior Art

The so-called Kettering ignition system has been commonly used for internal combustion engines for many years. The Kettering system is an inductive storage system basically consisting of the ignition coil, breaker contacts (points), the point capacitor, ballast resistor, and the DC power supply. The Kettering circuit is simple to understand, easy to service and generally dependable; however, it does have some objectionable characteristics. At low engine speeds, the point current may be too high resulting in short point life, the inductance of the primary winding of the ignition coil is typically too high for high speed operation, and the rise time of the secondary winding high voltage is typically too slow to insure adequate ignition voltage under adverse conditions. Furthermore, the Kettering circuit tends to produce a misfire condition when the ignition key or switch is turned-off at a time when the breaker points are closed.

Some improvements have been made in the Kettering system by replacing the breaker points with semi-conductors thereby eliminating the point wear and maintenance, and by using transistors to carry the heavy current of the primary winding of the ignition coil, using the breaker points to carry only the small control current for the transistors. While ignition coils having a lower primary winding inductance have been used for better high speed performance, the optimum value of the coil inductance is still a compromise when considering a range of engine speed and engine starting; improvement in one condition usually results in a sacrifice in other conditions, such as improving the high speed performance while lowering the low speed performance and making engine starting more difficult.

Numerous capacitor discharge ignition systems have been provided which have solved some of the problems inherent in the Kettering system but which have other problems of their own. One common form of capacitor discharge ignition system, as shown and described in U.S. Pat. Nos. 3,658,044, 3,704,699 and 3,714,507 employs a DC to AC inverter circuit which converts the battery voltage to high voltage alternating current, a rectifier, a capacitor connected in series with the primary winding of the ignition coil across the output of the rectifier, a silicon controlled rectifier also connected across the output of rectifier which, when turned-on, discharges the capacitor through the primary winding of the ignition coil, and a trigger circuit coupled to the gate element of the silicon controlled rectifier for providing a trigger signal to turn-on the silicon controlled rectifier in response to opening of the breaker points.

Some capacitor discharge ignition systems tend to misfire with varying battery voltage during cranking or when the ignition key or switch is turned-on or turned-off. Misfiring during cranking may damage the starter mechanism, and misfiring during key turn-on or turn-off will eventually cause conducting carbon paths to form between the terminals on the insulating surface inside of the distributor cap, such carbon paths also eventually causing misfiring. The most objectionable misfiring condition which occurs in prior capacitor discharge ignition systems is multiple firing, i.e., the condition when the next cylinder to be fired is fired prematurely along with the normally-fired cylinder. These two cylinders may be fired simultaneously or the misfiring may occur just after the spark break-off of the normal cylinder, or at a time at the end of the primary ringing with the system power capacitor. Simultaneous firing occurs with capacitor discharge ignition systems having excessive high voltage capacities at a time when the output voltage requirement for spark breakdown or corona ignition are at a minimum such as at low speed or idle with a hot, lean air-gas mixture. Such pre-ignition misfiring may occur after normal spark break-off since the secondary voltage of the ignition coil will rise to a very high level by reason of a very rapid rate of flux decrease or decay. If this high secondary voltage transient would cause a new spark to occur at the normal cylinder, there would be no harm done; however, the normal cylinder that has just fired may still be under sufficiently high compression to make spark break-down impossible even at that high voltage while, at the same time, the next cylinder in sequence is only under light compression and even with its large distributor cap air-gap, the high secondary voltage may be sufficient to cause pre-ignition by spark break-down or by corona ignition. Some capicator discharge ignition systems provide protection from multiple misfiring at cranking and low speeds by lengthening the spark duration or the duration of primary ringing; however, at high speeds, no protection against multiple misfiring is provided. Multiple misfiring may occasionally go unnoticed at moderate or high speeds however, in addition to lowering the efficiency, multiple misfiring may cause early engine failure such as blown piston heads, broken connecting rods or shortened distributor cap life. Furthermore, many prior capacitor discharging ignition systems tend to misfire during cranking due to loss of control of the triggering logic when the battery voltage drops to too low a level for properly engerizing.

Certain prior capacitor discharge ignition systems are not capable of high speed operation by reason of the inverter oscillation being stopped by the silicon controlled rectifier shorting the secondary winding of the inverter when the silicon controlled rectifier is turned-on, and also because the inverter is overloaded in the first portion of the capacitor charging cycle.

Other prior capacitor discharge ignition systems which use a large reservoir capacitor followed by a voltage doubling reactor which charges the power capacitor are not capable of high speed operation. In those systems, although the inverter oscillation is continuous, the reactor output falls off at high speeds because of slow inductance.

Despite the above-enumerated problems encountered in the use of prior capacitor discharge ignition systems, the capacitor discharge ignition system has numerous advantages as compared with the Kettering system such as lower point current with longer point life, both lower speed and higher speed capability, better cold weather starting, longer plug life by reason of less average plug current, better ignition even with fouled plugs and better fouled plug cleaning, and better ignition even with a defective ignition coil which has short-circuited coil sections. An outstanding feature of capacitor discharge ignition systems over the Kettering system is the rachet effect during the charging of the power capacitor; even though the battery voltage may dip or remain at a very low level just before the firing time, as may occur during cranking, the power capacitor will be charged at the highest battery voltage that occured from the time of the preceeding firing and thus will be able to produce a good spark. This is not possible with the Kettering or transistorized Kettering system since the maximum amphere-turns of the primary winding circuit of the ignition coil will decrease when the battery voltage is lower.

SUMMARY OF THE INVENTION

In accordance with the invention, in its broader aspects, a capacitor discharge ignition system is provided including an ignition transformer having a low voltage primary winding and a high voltage secondary winding adapted to be coupled in sequence at predetermined times to a plurality of spark devices, and means are provided for generating a pulse at such predetermined times. A source of direct current potential is provided and a power capacitor in series with the primary winding across said source and is charged thereby. Gate means are provided for short-circuiting the direct current potential source in response to a control signal so that the power capacitor discharges through the primary winding, and control means is provided for providing a control signal in response to each such pulse. In accordance with an important aspect of the invention, a ringing capacitor is coupled across the primary winding and is proportioned to provide a damped oscillatory current therein when the gate means removes the short circuit from the direct current potential source thereby clamping the peak induced voltage in the secondary winding to a predetermined value to inhibit misfiring. The ringing capacitor thus limits the rate of flux decay in the secondary winding by clamping or ringing-out the remaining flux after normal spark break-off. My capacitor discharging ignition system thus offers protection against misfiring at all speeds.

In accordance with another important aspect of the invention, the direct current potential source includes a DC to AC inverter having an output circuit, a rectifier coupled to the output circuit, and another capacitor series-connected in the output circuit which prevent stopping of the oscillation of the inverter when the gate means is turned-on to short circuit the rectifier.

In accordance with yet another important aspect of the invention, the pulse generating means includes breaker contact adapted to be opened at the predetermined times and having a capacitor coupled there across, the ringing and last-mentioned capacitor having generally the same capacitance, and the control means includes an inductive element for coupling the contacts across another source of direct current potential, and time delay means for coupling the inductive element to the gate means, the time delay means delaying the control signal for a time longer than contact bounce time. A diode is coupled in parallel across the inductive element and the contacts and is polorized so that current due to flux decay in the inductive element upon opening the contacts charges the breaker contacts capacitor. A zener diode is coupled in circuit with the inductive element for limiting the flux density thereof and for discharging the breaker contacts capacitor after the control signal is terminated and before the contacts are closed. With this arrangement, a pulse for turning-on the gate means is provided at precisely the instant when the breaker contacts are opened after having been closed for a predetermined time. Thus, point bounce, switching transients, or battery variations cannot cause misfiring of the control or trigger circuit.

It is accordingly an object of the invention to provide an improved capacitor discharge ignition system.

Another object of the invention is to provide an improved capacitor discharging system wherein misfiring is inhibited by clamping the secondary winding of the ignition coil to a limited peak output voltage.

Yet another object of the invention is to provide an improved capacitor discharging ignition system of the type employing a DC to AC inverter and rectifier circuit and gate means which short-circuits the rectifier in order to discharge the power capacitor wherein stopping of the oscillation of the inverter by short-circuiting the rectifier is prevented.

A further object of the invention is to provide an improved capacitor discharge ignition system of the type employing gate means coupled to discharge the power capacitor and a triggering circuit for actuating gate means wherein contact bounce, switching transients or battery voltage variations do not cause misfiring of the trigger circuit.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENTS

Figure 1:
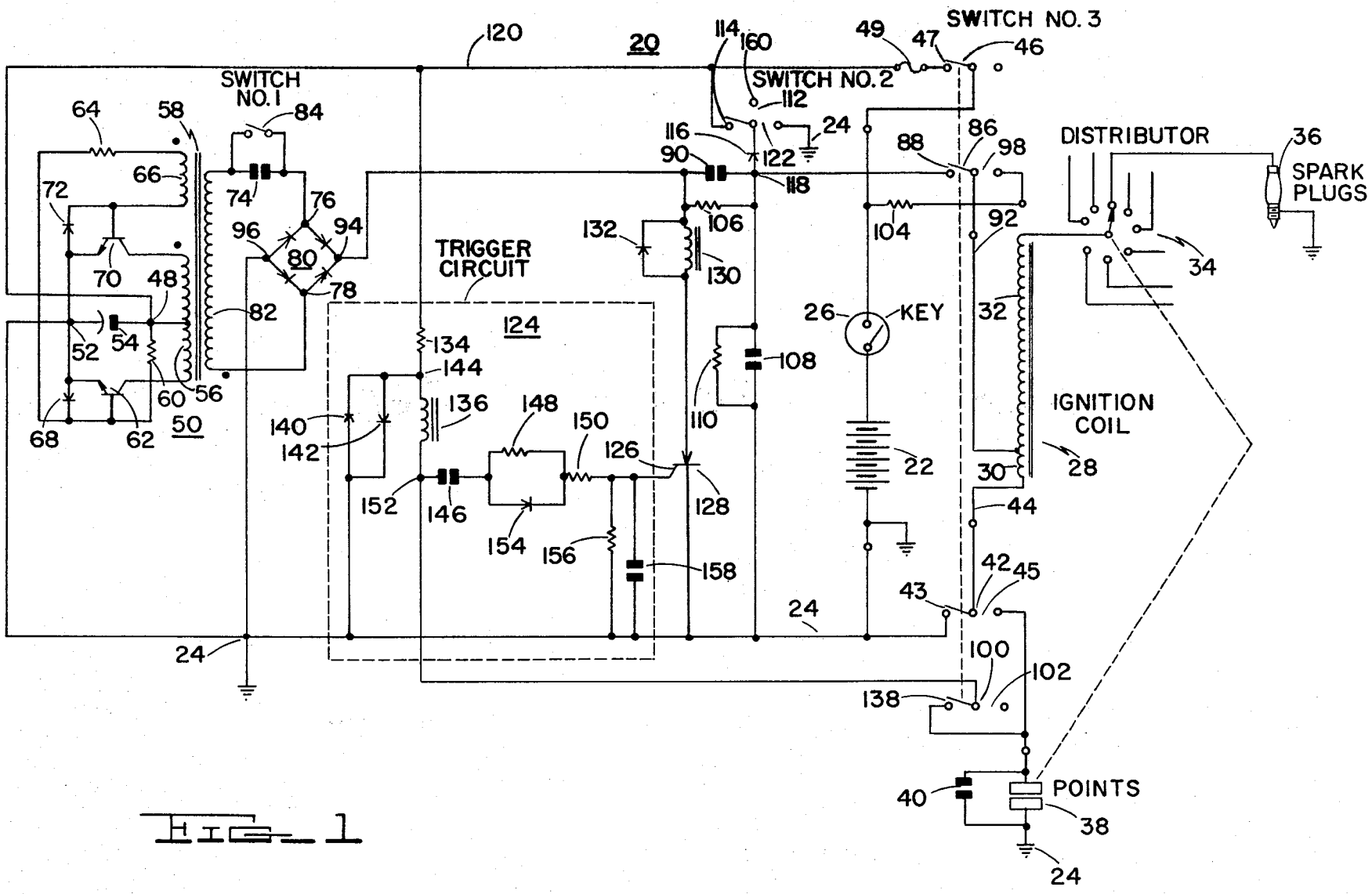
FIG. 1 is a schematic illustration of the preferred embodiment of the invention employed in a negative-grounded battery system.

Referring now to FIG. 1, the preferred embodiment of my improved capacitor discharge ignition system, generally shown at 20, comprises battery 22 having its negative terminal grounded, as at 24 and having ignition switch 26 connected in series with its positive terminal. Ignition coil 28 is provided having primary winding section 30 and secondary winding section 32; while ignition coil 28 is shown as being auto transformer-connected, it will be understood that isolated primary and secondary windings may be employed. Convention distributor 34 operated by the engine (not shown) sequentially couples high voltage secondary winding section 32 of ignition coil 28 to spark plugs 36, only one of which is shown. Breaker points or contacts 38 are also operated by the engine in synchronism with distributor 34, contacts 38 being open each time distributor 34 connects secondary winding section 32 to a particular spark plug. Capacitor 40 is connected across contacts 38.

Double throw switch 42 selectively connects end 44 of primary winding section 30 to ground 24 or to breaker contacts 38. Switch 46, ganged with switch 42, connects the positive side of battery 22 to input terminal 48 of Royer push-pull DC to AC inverter 50, the other input terminal 52 being connected to ground 24. Capacitor 54 is connected across input terminals 48, 52. Input terminal 48 is connected to the midpoint of primary winding 56 of transformer 58. Resistor 60 connects input terminal 48 to the base of transistor 62. The base of transistor 62 is connected by resistor 64 to one side of tickler winding 66 of transformer 58. One side of primary winding 56 transformer 58 is connected to the collector of transistor 62, which has its emitter connected to input terminal 52. Diode 68 is connected across the base and emitter of transistor 62. The other side of tickler winding 66 is connected to the base of transistor 70 which has its collector connected to the other side of primary winding 56 and its emitter connected to input terminal 52. Diode 72 is connected across the base and emitter of transistor 70.

Capacitor 74 is connected in series with input terminals 76, 78 of bridge rectifier 80 across secondary winding 82 of transformer 58. Switch 84 is connected across capacitor 74.

Double-throw switch 86, also ganged with switches 42 and 46, in its position 88 connects power capacitor 90 between end 92 of primary winding section 30 of ignition coil 28 and output terminal 94 of rectifier 80. Output terminal 96 is connected to ground 24. Thus, with switch 42 in position 43 and switch 86 in position 88, power capacitor 90 and primary winding section 30 of ignition coil 28 are connected in series across output terminals 94, 96 of rectifier 80.

With switch 42 in position 45, switch 86 in position 98, and switch 100, also ganged with switches 42, 46 and 86, in position 102, ignition switch 26, ballast resistor 104, primary winding section 30 of ignition coil 28, and the parallel-connected breaker contacts 38 and capacitor 40, are connected in series across battery 22 to provide the standard Kettering circuit.

Bleeder resistor 106 is connected across power capacitor 90. Ring capacitor 108 with bleeder resistor 110 connected thereacross is connected in parallel with primary winding section 30 of ignition coil 28 when switch 86 is in position 88 and switch 42 is in position 43. Double throw switch 112 in position 114 connects diode 116 from point 118 between power capacitor 90 and primary winding section 30 (with switch 86 in position 88) to positive battery line 120 (with switch 46 closed), and switch 112 in position 122 connects diode 116 to ground 24.

Power capacitor 90 which is charged by high voltage direct current supplied by rectifier 80 is discharged in response to opening of breaker contacts 38 by trigger circuit 124 coupled to trigger element 126 of silicon controlled rectifier 128. Silicon controlled rectifier 128 is connected in series with interference suppresser reactor 130 across output 94, 96 of rectifier 80 and thus, when silicon controlled rectifier 128 is turned-on, rectifier 80 is short-circuited thereby to discharge power capacitor 90 through primary winding section 30 of ignition coil 28 (with switches 42, 86 in positions 43, 88, respectively). Clamp diode 132 is connected across reactor 130.

In the embodiment of trigger circuit 124 shown in FIG. 1, resistor 134, and triggering reactor 136 are connected in series with breaker contacts 38 across positive battery line 120 and ground 24 by switch 100 in its position 138 and switch 46 in position 47. Diodes 140, 142 are connected in parallel between point 144 between resistor 134 and reactor 136 and ground 24. Coupling capacitor 146 and resistors 148, 150 connect point 152 between reactor 136 and switch 100 to trigger element 126 of silicon controlled rectifier 128. Diode 154 is connected across resistor 148 and resistor 156 and capacitor 158 are connected between trigger elements 126 and ground 24.

Operation of the Circuit of FIG. 1 and Trigger Circuit 124

In describing the operation of the circuit of FIG. 1 and trigger circuit 124, component values used in a specific embodiment of the invention will also be given. The circuit of FIG. 1 is a preferred embodiment for use with engines where the negative side of the battery is grounded to the chassis. The circuit of FIG. 1 uses three switches, number one (84), number two (112), and number three (42, 46, 86, 100). When switch number one is in its OFF position, the capacitor discharge system is suitable for high speed operation whereas, when switch number one is in its ON position, the systems' maximum operating speed is lowered and limited. Switch number two controls selection of three modes of the spark or high voltage output of ignition coil 28 when the capacitor discharge system is used. When switch number two is in its position 160 or OFF position, the output of ignition coil 28 will be alternating current. When switch number two is in either position 122 or 114 the output of ignition coil 28 will be direct current, the length of the spark duration with switch number two in its position 114. Switch number three in its position 45, 98, 102 selects the standard Kettering ignition system whereas, in its position 43, 47, 88, 138, the capacitor discharge system is selected. Fuse 49 connects position 47 of switch 46 to positive battery line 120.

The operation of the capacitor discharge system will now be described with switch number one in its OFF position, switch number two in its OFF position 160, and switch number three in its capacitor discharge position 43, 47, 88, 138. When ignition key 26 is closed, the voltage of battery 22 is applied to inverter 50 at the anode of capacitor 54 and to trigger circuit 124 at resistor 134. As the voltage increases across capacitor 54, current begins to flow through resistor 60 and through transistor 62 between the base and emitter thereof to ground 24. This base current turns-on transistor 62 resulting in current flow from the center tap of primary winding 56 of transformer 58 through one-half of the primary winding and through transistor 62 between the collector and emitter to ground 24. By the mutual inductance of primary winding 56 and tickler winding 66, current flows in the tickler winding of such polarity that is increases the base current of transistor 62 causing it to turn ON more completely. Thus the oscillation of inverter circuit 50 is started.

The current from tickler winding 66 flows through resistor 64, through transistor 62 between the base and emitter, and through diode 72 back to tickler winding 66. After the current flow through transistor 62 saturates the core of transformer 58, the current through tickler winding 66 falls to zero thereby turning OFF transistor 62. After saturation of the core transformer 58, the flux begins to decrease causing the induced voltage and current in tickler winding 66 to reverse thereby turning ON transistor 70 through its base and emitter, diode 68, and resistor 64. After the current through transistor 70 saturates the core of transformer 58, transistor 70 will turn OFF and transistor 62 will again turn ON thereby beginning another cycle.

By mutual inductance between primary winding 56 and high voltage secondary winding 82 of transformer 58 and by their turns ratio, a high voltage is induced in secondary winding 82 causing current flow through capacitor 74 and bridge rectifier 80, capacitor 90, primary winding 30 of ignition coil 28, and bridge rectifier 80 back to secondary winding 82. During each one-half cycle of the output of inverter 50, the direct current voltage of capacitor 90 increases until it is approximately equal to the peak voltage across secondary winding 82 of inverter transformer 58.

In a specific embodiment, capacitor 54 is a 22mfd, 25 volt, direct current capacitor used to reduce ripple voltage, to maintain a near constant direct current battery voltage for the input of inverter 50, and to reduce radio frequency interference. Capacitor 74 is a 0.047 to 0.22 mfd, 400 volt AC capacitor which provides series impedance in the output of inverter 50, prevents overloading the inverter, and permits the inverter to supply its maximum output at high speeds. Diodes 68 and 72 are one amphere, 1 IN5059A or the equivalent; when transistor 62 is ON, diode 72 is ON while transistor 70 and diode 68 are OFF, and vice versa. Diode 68, 72 are sometimes referred to a "steering diodes" and they also serve to limit the reverse base-to-emitter voltage of transistors 62, 70 to their ON voltage. Resistor 64 is a 25 to 50 ohm, 10 watt resistor used as a current limiting resistor in the regenerative feedback circuit of the bases and emitters of transistors 62, 70. By using a high feedback voltage and then limiting the current, fast switching time is possible for maximum output. Resistor 60 is a 470 to 1 K ohm, ½ watt resistor which unbalances the circuit to insure that oscillation starts after turn-on, and which supplies extra base drive current to transistor 62. Transistors 62, 70 are RCA 2N3055 or the equivalent. Silicon controlled rectifier 128 is a 400 volt C6D, C106D, C20D, C30D or equivalent.

Capacitor 40 is a 0.2 mfd capacitor which is the standard point capacitor used in the Kettering circuit. Capacitor 90 is a 1.0 to 3 mfd, 400 volt, AC capacitor and is the capacitor discharge power capacitor which discharges into the 6 or 12 volt primary winding section 30 of ignition coil 28. Capacitor 108 has approximately the same capacitance as point capacitor 40, i.e., 0.22 mfd, 400 volt alternating current capacitor. Resistor 110 is a 33 K ohm, 1 watt resistor which removes the charge from capacitor 108 and which protects the capacitor discharge components in the event of an open in the circuit of primary winding section 30 of ignition coil 28. Resistor 106 is a 1 to 2 megohm, ½ watt resistor which serves as a bleeder load across capacitor 90 to improve the voltage regulation, and which also functions to remove the charge of capacitor 90 after ignition switch 26 has been turned-off. Reactor 130 is a small, 30 to 50 microhenry air or ferrite core reactor used to suppress radio frequency interference by slowing the switching time of SCR 128. It also provides protection to some of the capacitor discharge system components by limiting peak currents. Diode 132 is a 1 amp., 1N5062 or equivalent, and functions to clamp the voltage near zero that is produced by the decreasing flux density of reactor 130 after reactor 130 conducts the power pulse to the anode of SCR128. Diode 132 blocks the ringing of reactor 130 with capacitor 90 to limit the voltage across the primary winding section 30 of ignition coil 28 to approximately the full charge voltage of capacitor 90. Diode 132 also functions to shorten the turn-off time of SCR 128.

Diode 116 is a 3 amp, 1N5626, or equivalent, and functions to limit the ringing of primary winding section 30 of ignition coil 28 with capacitors 90, 108 to two predetermined levels thereby producing a direct current high voltage spark output of adjustable duration. With switch number two in its position 122, diode 116 clamps the fly-back reversal voltage of primary winding section 30 to the forward ON voltage drop of diode 116. Position 122 of switch number 2 produces the longest DC spark possible because the decreasing flux is clamped at almost its maximum density. With switch number two in its position 114, diode 116 clamps the fly-back reversal voltage of primary winding section 30 to the forward ON voltage drop of diode 116 plus the voltage of battery 22. In position 114 of switch number two, the time of turn-on of diode 116 is delayed by the bias voltage provided by battery 22. This produces a shorter DC spark than with switch number two in its position 122 because the decreasing flux density is clamped at a later time after primary winding section 30 has transferred some of the core energy into capacitors 90 and 108. Normal high voltage spark breakdown occurs during the first part of the first one-half cycle when the flux is increasing. Diode 116 clamps during the first part of the second one-half cycle and although the clamp is on primary winding section 30, it effectively clamps the secondary winding by reason of mutual inductance.

To explain the operation of trigger circuit 124, it will be assumed that breaker points 38 have been closed, that the flux density of reactor 136 has reached its maximum steady state condition, and that breaker points 38 have just been opened. As breaker contacts 38 open, the voltage at point 152 at the junction of capacitors 40, 146, will immediately rise from zero to a positive value being driven first by the voltage of battery 22 through resistor 134 and then by the flux decay of reactor 136. Thus, a turn-on pulse will be conducted to gate element 126 of SCR128 through capacitor 146, diode 154 and resistor 150. After the turn-on pulse, the positive voltage remaining at point 152 will be discharged through diode 142 to the turn-on voltage of diode 142. After breaker contacts 38 again close, capacitors 146 and 40 will completely discharge however, capacitor 146 discharges at a slower rate than capacitor 40 since its discharge path is through resistors 148, 150, 156.

When SCR 128 is turned-on, it discharges capacitor 90 through primary winding section 30 of ignition coil 28. By mutual inductance and the turns ratio of the primary and secondary winding sections 30, 32 of ignition coil 28, a high voltage is present at the rotor of distributor 30 for distribution to spark plugs 36. As the current through the anode circuit of SCR 128 drops below its minimum holding level, SCR 128 turns OFF which ends the firing of the particular spark plug 36 selected by distributor 34.

Trigger circuit 124 has the ability to produce an ideal turn-on pulse for SCR 128 at precisely the instant breaker contacts 38 open after having been closed for a predetermined time. Point bounce, switching transients or battery voltage variations cannot cause trigger circuit 124 to misfire. Point bounces occur at a small fraction of the predetermined time required for reactor 136 to reach a flux density high enough for triggering. Step voltage variations from zero to voltages that exceed the normal battery voltage which might occur at any frequency, as during cold weather cranking, will not cause a misfire. In an abnormal condition when the voltage of battery 22 remains at a level too low and too long for the trigger circuit to turn-on SCR 128, trigger circuit 124 will still produce only one weak pulse at gate element 126 of SCR 128 at the precise time when breaker contacts 38 open.

Resistor 134 provides means for adjusting the point current and also reduces the battery voltage to a suitable level for reactor 136. Diode 140 improves triggering by providing a low impedance path for the discharge of reactor 136, to point capacitor 40 and the gate load of SCR 128, which are in parallel, through diode 140. Without diode 140, reactor 136 would charge capacitor 40 and the gate load through the battery and resistor 134 path which is a higher impedance path than that provided by diode 140. Diode 140 thereby improves the trigger operation by lowering the minimum battery voltage required for triggering. Diode 142 functions as a zener diode during operation with high battery voltage. During triggering, capacitor 40 discharges into the gate load as the voltage of reactor 136 starts decreasing. Diode 142 discharges capacitor 40 to its turn-on voltage after SCR 128 has been triggered. The voltage of point capacitor 40 remains at the clamped turn-on voltage of diode 142 until the points close, and then the points completely discharge capacitor 40. For a different design of reactor 136, it may be desirable to employ two or more diodes 142 in series, or a zener diode may be used in place of diode 142. The low charge voltage of point capacitor 40 at the time of discharge into breaker contacts 38 lengthens the point life.

Capacitor 146 provides a limiting DC coupling between pulse generating reactor 136 and gate element 126 of SCR 128. Further, capacitor 146 is the power source which provides slightly negative voltage at gate element 126 when capacitor 146 is discharging. Capacitor 146 also reduces the otherwise higher average pulse current to gate element 126 of SCR 128 at high speeds since it will have insufficient time between pulses to complete the discharge. Resistor 148 is the highest or main controlling resistance for discharging capacitor 146 between further pulses. Diode 154 provides a low resistance path in its forward direction for conducting the turn-on pulse to gate element 126. After conducting the turn-on pulse, diode 154 turns-off thereby blocking the reverse voltage of capacitor 146 while capacitor 146 discharges through resistor 148. Resistor 150 is a current limiting and decoupling resistor to prevent false triggering. Resistor 156 and capacitor 158 are used to clamp the gate current leakage to near zero voltage, and to prevent any transient from false triggering the gate of SCR 128. The combination of resistor 148 and diode 154 is used for optimum performance and for increasing the reliability of the system, however, trigger circuit 124 would continue to function without misfire if resistor 148 and diode 154 should be short circuited.

In a specific embodiment, capacitor 146 is a 0.1 to 0.47 mfd capacitor. As the speed of triggering is increased, capacitor 146 provides some improvement in regulation to reduce an otherwise higher average pulse current to the gate of SCR 128. The other circuit components of triggering circuit 124 are chosen so as not to allow capacitor 146 sufficient time to completely discharge at high speeds, and so as not to allow capacitor 146 sufficient time to discharge sufficiently to pass a trigger pulse strong enough to trigger SCR 128 during the point bounce period. Capacitor 158 is a 0.1 mfd capacitor. Resistor 148 is a 2.7 to 5 K ohm, ½ watt resistor used in trigger circuit 124 to prevent SCR 128 from being able to re-fire immediately after firing. The turn-on pulse for SCR 128 passes through diode 154 in its forward direction and capacitor 146 receives a charge from the turn-on pulse. Capacitor 146 must have a discharge path to partially remove its charge before it is able again to pass enough current to turn-on SCR 128 for another cycle. Resistor 148 allows capacitor 146 to discharge slowly; capacitor 146 starts to discharge through resistor 148 immediately after conducting the turn-on pulse.

Resistor 150 is a 33 ohm, ½ watt resistor used as a current limiting and decoupling resistor to aid in preventing false triggering. Resistor 158 is a 100 ohm, ½ watt resistor which serves as a bi-directional path for discharging capacitors 146 and 158. Resistor 156 prevents transients from false triggering SCR 128 by keeping the voltage of capacitor 158 and gate element 126 of SCR 128 near zero between trigger pulses. Resistor 156 also shunts the leakage current of SCR 128 to ground.

Turning now particularly to ring capacitor 108, in the absence of capacitor 108, when SCR 128 is turned-off and if at that time bridge rectifier 80 is blocking, both the primary and secondary winding sections 30, 32 of ignition coil 28 may be unloaded and thus, the secondary voltage can rise to a very high level since the rate of flux decrease will be very rapid. With the inclusion of ring capacitor 108, when SCR 128 is turned-on, primary winding section 30 of ignition coil 28 rings with the power capacitor 90 and ring capacitor 108 which are then effectively in parallel. After SCR 128 turns-off, primary winding section 30 and power capacitor 90 can only ring together in one direction since bridge rectifier 80 will block the ringing in the other direction; however, ring capacitor 108 which is in parallel with primary winding section 30 will continue to ring with primary winding section 30 in both directions or in both polarities, i.e., ring capacitor 108 provides a damped oscillatory current in primary winding section 30 which clamps the peak induced voltage in secondary winding section 32 to a level sufficiently low to inhibit misfiring. Ring capacitor 108 thus functions to limit transient high voltage spikes in the output of secondary winding section 32 of ignition coil 28 which otherwise might cause pre-ignition misfiring. Effectively, by the mutual conductance of primary and secondary winding sections 30, 32 ring capacitor 108 loads and lowers their ringing frequencies and thus provides misfire protection against output transients at all times during all of the switching, i.e., when SCR 128 is turned-on or turned-off, when the rectifiers of bridge rectifier 80 turn-on or turn-off, when the rectifiers of bridge rectifier 80 block the ringing of primary winding section 30 with power capacitor 90, and when the high voltage spark breaks off after normal firing.

Some prior capacitor discharging ignition systems known to the present applicant have employed small capacitors, i.e., from 0.005 to 0.01 mfd, connected in parallel with the primary winding section of the ignition coil for the purpose of RF by-pass or eliminating radio frequency interference. However, the size range of capacitor 108 in the system of the present invention is approximately the same as that used for point capacitor 40 in the Kettering circuit, capacitor 108 is approximately 20 to 40 times larger in size than the radio frequency eliminating capacitors previously employed, and capacitor 108 functions in its power ringing mode in a manner the same as point capacitor 40 functions in the standard Kettering system after the points open.

Figure 2:
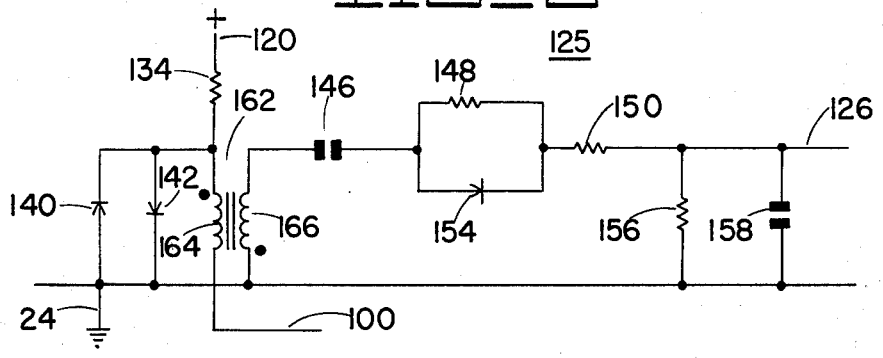
FIGS. 2, 3, 4 and 5 are fragmentary schematic illustrations showing other embodiments of the improved triggering circuit of my invention.

Referring now to FIG. 2, in which like elements are indicated by like reference numerals, trigger circuit 125 is very similar to trigger circuit 124; however, reactor 136 is replaced by transformer 162 having its primary winding 164 connected in series with resistor 134 and having capacitor 146 connected to its secondary winding 166. The primary-to-secondary turns ratio of transformer 162 is variable; however, it is not critical, and a one-to-one ratio works very well. While reactor 136 of trigger circuit 124 may have 200 turns with approximately 4 ohms resistance, transformer 162 of trigger circuit 125 may have a 200 turn secondary winding with a resistance of approximately 10 ohms.

Figure 3:
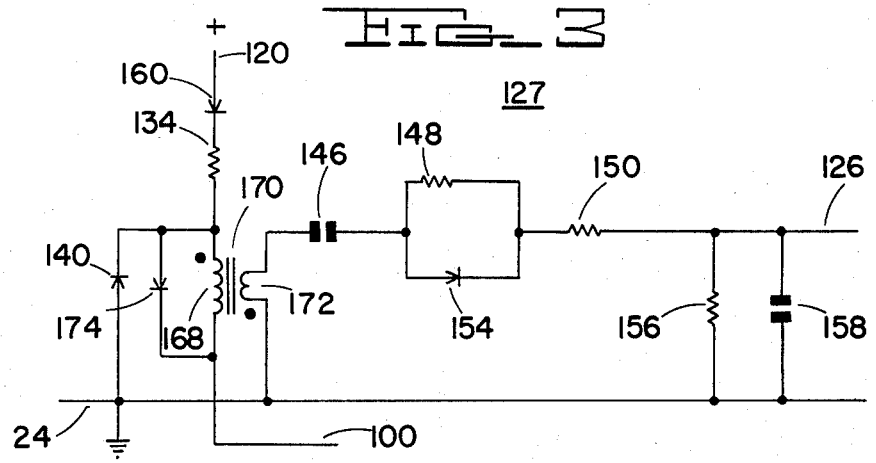

Referring now to FIG. 3 in which like elements are again indicated by like reference numerals, trigger circuit 127 differs from circuit 125 in that diode 160 is connected in series with resistor 134 and primary winding 168 of transformer 170, and diode 174 is connected directly across primary winding 168.

In operation of the circuit of FIG. 3, point capacitor 40 (FIG. 1) discharges into the breaker contacts 38 when charged to approximately the voltage of battery 22 whereas, with the trigger circuits 124 and 125, point capacitor 40 discharges into the breaker points at a voltage equal to the turn-on voltage of diode 142. Use of the trigger circuit 127 of FIG. 3 is recommended in very dirty environments where a high point current may be desirable. When using a 12 volt battery, the primary-to-secondary turns ratio of transformer 170 can be approximately two-to-one.

Diode 160 functions as a DC block which is especially useful where the resistance of resistor 134 is low. Diode 160 prevents point capacitor 40 from discharging causing a misfire at a time when breaker contacts 38 are open during the time when the battery voltage suddenly goes low or to zero. Diode 174 functions as a zener to increase the operative voltage variation range when the DC resistance of primary winding 168 of transformer 170 is high. In a specific embodiment, diode 160 and 174 are 1 amp., 1N5059A, or equivalent. Transformer 170 has a 100 turn insulated secondary winding with a resistance of about 6 ohms.

Figure 4:
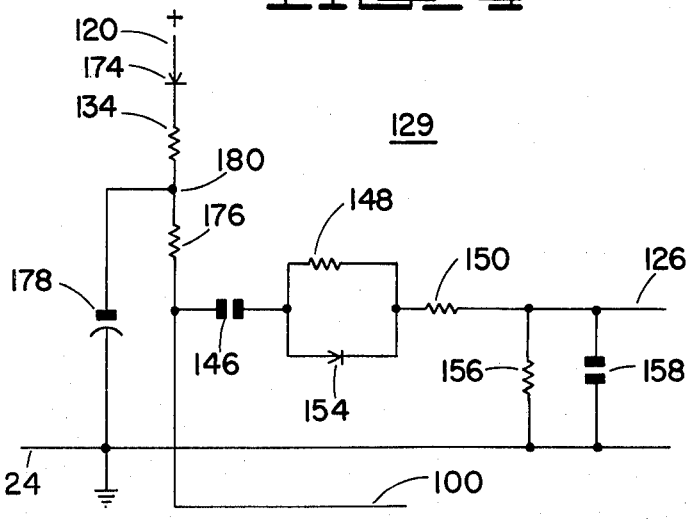

Referring now to FIG. 4 in which like elements are still indicated by like reference numerals, in trigger circuit 129, diode 174 is serially connected with resistor 134 and resistor 176 between positive battery line 120 and switch 100, and capacitor 178 is connected between midpoint 180 between resistors 134, 176 and ground 24. Here, the component values are chosen so that it is possible to turn-on SCR 128 only during a short time interval after breaker contacts 38 open after having been closed previously long enough for the circuit to reset itself. The capacitor and resistor 158, 156 connecting gate element 126 to ground 24 have a short time constant which prevents the gate from reaching a triggering level during voltage transient steps. To prevent misfire during key turn-on and during transient battery voltage increase steps, the time constant of resistor 134 and capacitor 178 is made much longer than the time constant of resistor 156 and capacitor 158. Diode 174 blocks the rapid discharge of capacitors 178, 40 and 146 when the battery power is removed or during transient battery voltage decrease steps. Resistor 176 limits and provides current adjustment when the points are closed, and capacitor 146 and resistors 176, 148 and 150 prevent misfire during point bounce.

In a specific embodiment, capacitor 178 is a 22 mfd, 25 volt DC capacitor, diode 174 is a 1 amp 1N5059A, and resistor 176 is a 47 ohm, 5 watt resistor.

Figure 5:
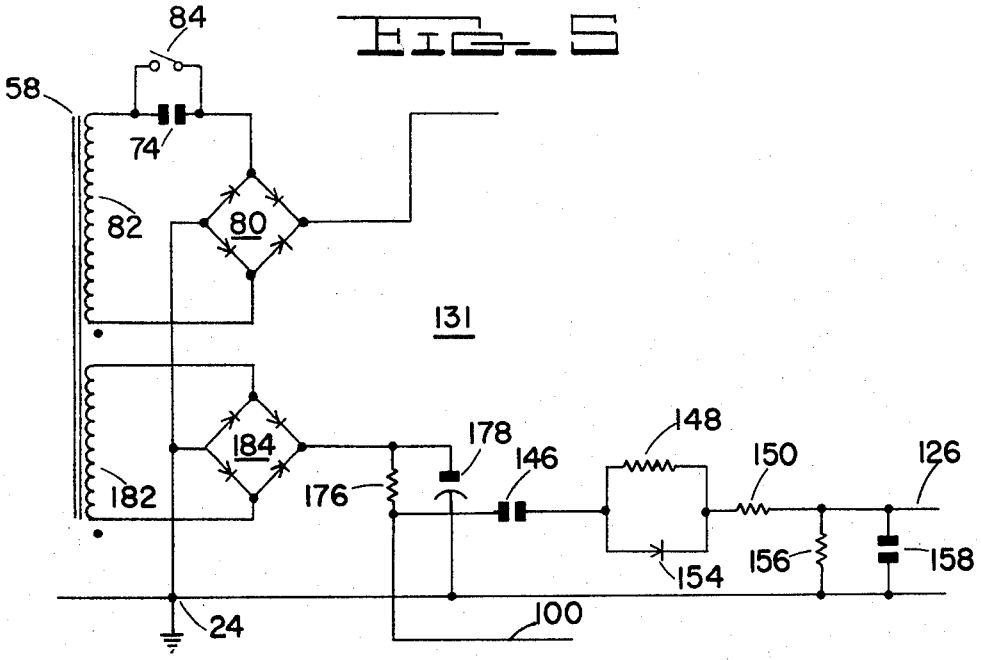

Referring now to FIG. 5 in which like elements are still indicated by like reference numerals, trigger circuit 131 does not use the battery 22 as the power source as in the case of the previous embodiments, but on the contrary uses rectified voltage provided by bridge rectifier 184 connected across secondary winding 182 of transformer 58. The no-load output at the anode of capacitor 178 of trigger circuit 131 when breaker contacts 38 are open is approximately 14 volts DC. If the breaker contacts 38 are open at the time the ignition key switch 26 is turned-on, misfire is not possible because of the slow rise of the trigger source voltage since resistor 156 is able to discharge capacitor 158 sufficiently fast to keep the voltage on gate element 126 below the minimum triggering level of SCR 128. The full wave rectifier bridge 184 functions in the same manner as diode 174 (FIG. 4) in blocking the rapid discharge of capacitors 178, 40 and 146 when the battery power is removed or during battery voltage decrease steps. Trigger power is available from capacitor 178 at all times during operation and capacitor 146 and resistors 176, 148, 150 prevent misfire during point bounce.

In a specific embodiment, the diodes of both rectifier bridges 80, 184 are 1 amp, 1N5059A or equivalent.

Figure 6:
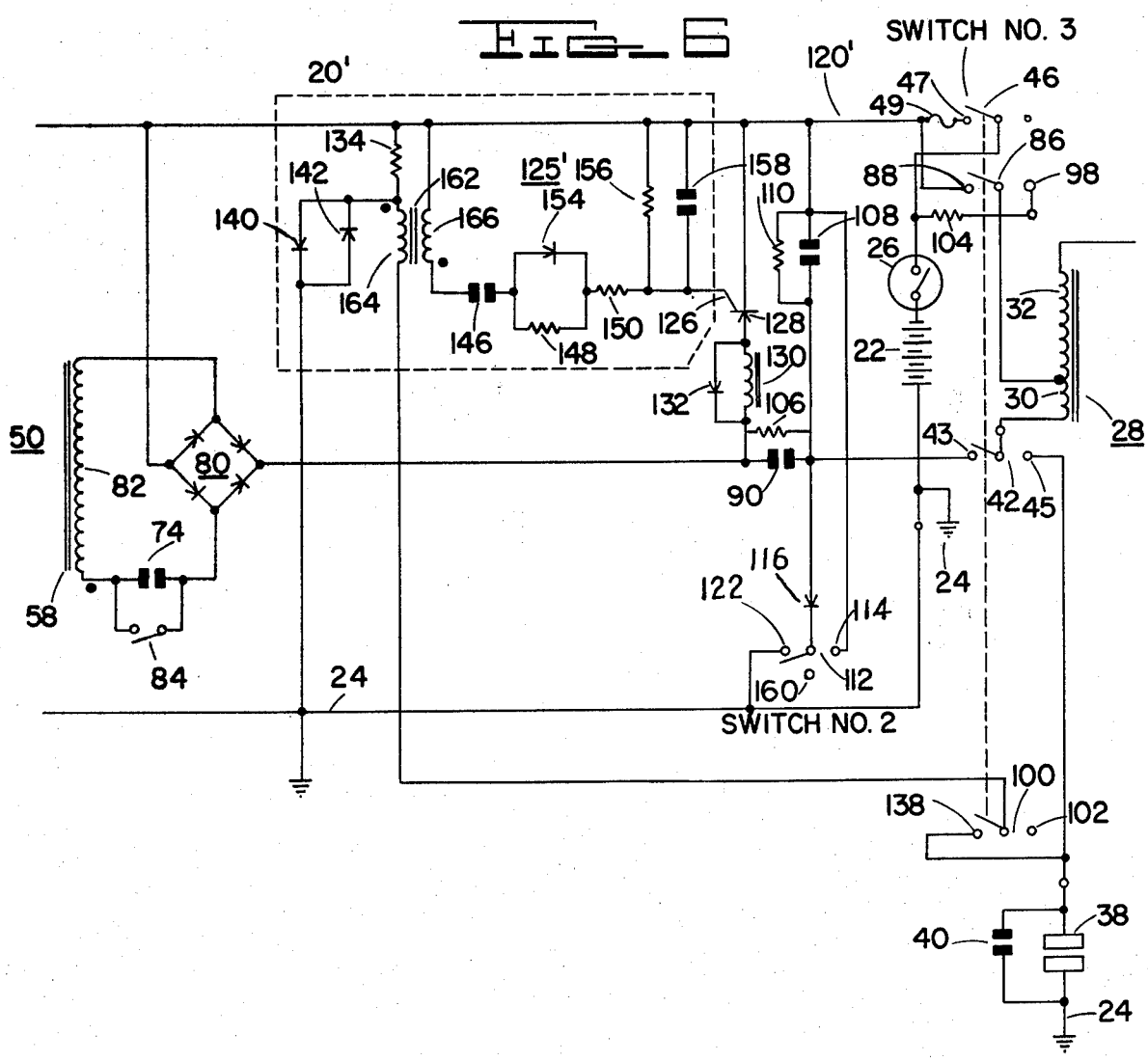
FIG. 6 is a schematic illustration showing the preferred embodiment of my invention embodied in a positive-grounded battery system.

Referring now to FIG. 6 in which like elements are indicated by like reference numerals and similar elements by primed reference numerals, there is shown a capacitor discharge system 20' similar to the system shown in FIG. 1 but with the modifications necessary to adapt the system for use in installations where the positive side of the battery is grounded to the chassis. The system of FIG. 6 uses triggering circuit 125' essentially the same as that shown in FIG. 2.

In the system of FIG. 6, the three switches function in the same manner as thos shown in FIG. 1, and the DC to AC inverter circuit 50 (only partially shown in FIG. 6) also functions in the same manner. Likewise, the output of inverter circuit 50 charges power capacitor 90 in the same manner as in FIG. 1.

In the system of FIG. 6, in order to have a positive trigger pulse for turning-on SCR 128, capacitor 146 is magnetically coupled by secondary winding 166 of transformer 162 to breaker contacts 38, and discharges through secondary winding 166 to the battery line 120' when the breaker contacts 38 are either open or closed. It will be readily seen that the primary-to-secondary turns ratio of transformer 162 is variable, but not critical, and a one-to-one ratio works very well. The system of FIG. 6 functions in the same manner as the system of FIG. 1 in all respects other than the trigger.

Figure 7:
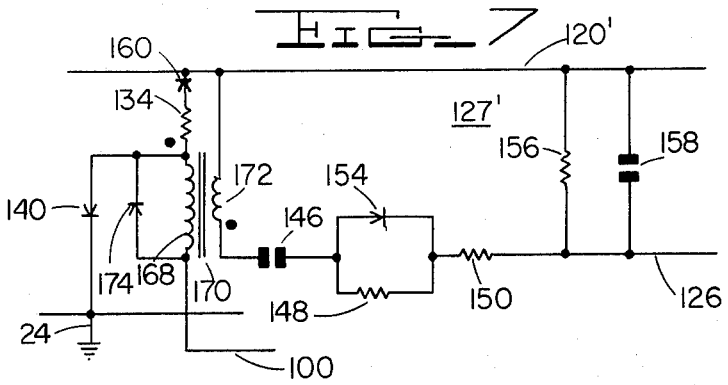
FIG. 7 is a fragmentary schematic illustration showing an alternative triggering circuit usable in the system of FIG. 6.

Referring now to FIG. 7 in which like elements are still indicated by like reference numerals and similar elements by primed reference numerals, trigger circuit 127' may be used in the positive-grounded system of FIG. 6 in lieu of trigger circuit 125'. It will be readily seen that trigger 127' is the same as trigger circuit 127 of FIG. 3 and will function in the same manner.

Figure 8:
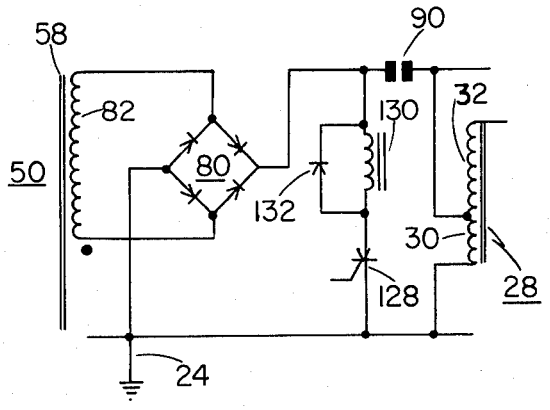
FIGS. 8 and 9 are fragmentary schematic illustrations useful in explaining the operation of the capacitor discharge ignition system of my invention.

Referring now to FIG. 8, the system of FIG. 1 is shown in fragmentary form but with capacitor 74 omitted, as by closing switch number one (84). Here, the output of full wave rectifier 80 charges capacitor 90. When SCR 128 is turned-on, it short-circuits secondary winding 82 of inverter 50 thereby stopping its oscillation and output. After SCR 128 is turned-off, inverter oscillation will restart and will again begin charging capacitor 90. However, when capacitor 90 is completely discharged or very lightly charged, it overloads inverter 50 and prevents it from supplying its full load capacity. As the terminal voltage of capacitor 90 increases, the amount of overload decreases.

In the operating cycle, since the inverter 50 stops oscillating and is slow to regain its full output rate, the use of the system without capacitor 74 or with switch number one (84) closed, limits the capacity discharge system to relatively moderate speeds. The system of FIG. 8 has some desirable features however; its efficiency is high and there is no possibility that SCR 128 will lock-up or remain turned-on because of it having an abnormally low holding current.

Figure 9:
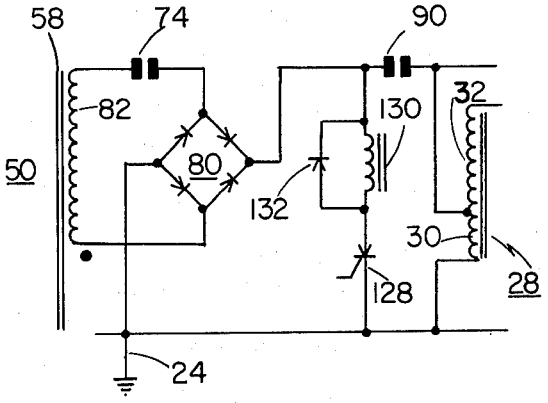

Referring now to FIG. 9, there is shown in fragmentary form the system of FIG. 1 with capacitor 74 included in series between secondary winding 82 of inverter transformer 58 and rectifier 80 (as by opening switch number one). The charging rate of capacitor 90 is controlled to a very large extent by the size of capacitor 74. Good high speed operation is possible with a capacitor 74 that is approximately two to ten percent of the size capacitor 90. Capacitor 74 inhibits stopping of the inverter 50 when SCR 128 is turned-on and prevents the overloading condition discussed above in connection with FIG. 8. By reason of capacitor 74, when SCR 128 is turned-on, additional impedance is provided in the short circuit loop which allows inverter 50 to idle and continue to oscillate. Thus, after SCR 128 turns-off, inverter 50 will be able immediately to supply its full load output to capacitor 90.

In operation, when ignition switch 26 is turned-on, both capacitors 74 and 90 have zero charges. During the first one-half cycle, both capacitors 74 and 90 receive equal watt-second charges since they are in series. The sum of the voltages of capacitors 74 and 90, neglecting rectifier and winding voltage drops, will equal the peak AC voltage across secondary winding 82 during the first one-half cycle until the time when the secondary winding voltage starts to decrease. Since capacitor 74 is much smaller than capacitor 90, and with their watt-seconds being equal, the voltage of capacitor 74 will be much higher than that of capacitor 90. During the last part of the first one-half cycle, as the voltage across the secondary winding 82 drops, the two diodes of bridge 80 which have been conducting will turn-off and the other two will now turn-on to allow capacitor 74 to discharge through winding 82 into capacitor 90.

At the end of the first one-half cycle, or at the time that the voltage of secondary winding 82 of inverter 50 reverses, the voltage of capacitors 74 and 90 will be equal since they have been effectively connected in parallel by the diodes of bridge 80. The second one-half cycle will be a repeat of the first one-half cycle except capacitor 90 will be partially charged and capacitor 74 will be reverse-charged. This mode of operation will continue until the voltage of capacitor 90 is equal to one-half or more of the peak AC voltage across secondary winding 82. At this time during the second mode of operation, capacitor 74 will no longer discharge into capacitor 90 when the winding voltage decays. Capacitor 74 will then maintain its charge since its voltage will be equal to or less than that of capacitor 90 and will not be able to turn-on the diodes of rectifier bridge 80. It will be observed that at the start of all one-half cycles except the first when capacitor 74 has zero voltage; capacitor 74 has a reverse or bucking voltage which the secondary winding 82 reverses while charging capacitor 90 to a higher voltage level. During the idling time when SCR 128 is turned-on, the AC peak-to-peak voltage on capacitor 74 is two times the peak voltage across inverter secondary winding 82. As the DC charge voltage increases on capacitor 90, the peak-to-peak voltage on capacitor 74 decreases and approaches zero when capacitor 90 is fully charged.

It will be observed that when switch number one (84) is in its ON position, the inverter output circuit becomes that shown in the fragmentary circuit of FIG. 8 whereas, when switch number one is OFF, the inverter output circuit becomes that shown in the fragmentary circuit of FIG. 9.

Spark output using the circuit of FIG. 8 will slightly exceed that using the circuit of FIG. 9 below an eight-cylinder engine speed of about 5,000 rpm; however, above about 5,000 rpm the output of the circuit of FIG. 8 falls off sharply below that of FIG. 9. The circuit of FIG. 9 is advantageous for very high engine speeds since it will charge capacitor 90 to about one-half normal voltage at about 15,000 rpm. Since the maximum compression obtainable falls off at high speed, the spark power or voltage required for ignition is less for high speed. The spark requirement is the greatest for a condition of maximum acceleration at low speeds.

Figure 10:
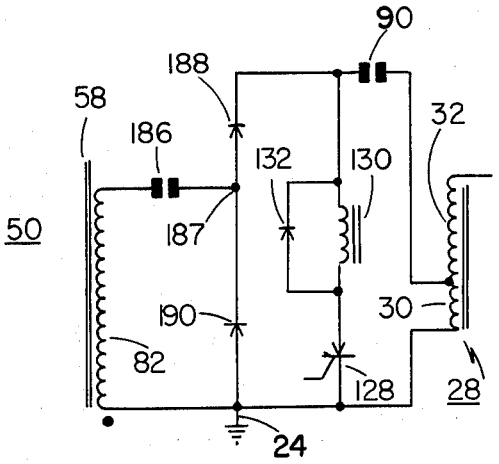
FIG. 10 is a fragmentary schematic illustration showing a voltage doubler power supply which may be used in the system of my invention.

Referring now to FIG. 10, there is shown, in fragmentary form, a modification of the circuit of FIG. 1 to include a conventional voltage doubler circuit in lieu of the bridge rectifier 80. Here, capacitor 186 couples inverter secondary winding 82 to mid-point 187 between diodes 188, 190 which are serially connected with capacitor 90 and primary winding section 30 of ignition coil 28. The sizes of capacitors 186 and 90, relative to each other, alter the conventional mode of operation of the voltage doubler circuit and make it suitable for use in a high speed capacitor discharge ignition system. Capacitor 186 must be an AC capacitor and in the circuit of FIG. 10, is much smaller than the power capacitor 90. Good high speed operation is obtained with a capacitor 186 that is approximately 2 to 15 percent of the size of capacitor 90.

When SCR 128 is turned-on, it shorts the output of inverter 50 with capacitor 186 in series with secondary winding 82 and thus, the oscillation of inverter 50 continues when SCR 128 is turned-on. When SCR 128 is turned-off, inverter 50 will be able immediately to supply its full load output to capacitor 90.

When ignition key 26 is turned-on, both capacitors 186 and 90 have zero charge. Assuming that the polarity of secondary winding 82 is such that diode 90 is conducting when the voltage is rising in secondary winding 82 during the first one-half cycle, the voltages of secondary winding 82 and capacitor 186 will be equal until the time when the voltage of the winding begins to decrease. At that time, capacitor 186 will discharge into capacitor 90 and secondary winding section 30 of ignition coil 28. The voltages of capacitors 186 and 90, neglecting rectifier and winding voltage drops, will be equal when the inverter output voltage polarity changes at the end of the first one-half cycle. However, the voltages of capacitors 186 and 90 will be considerably less than one-half the peak AC inverter output voltage because the total watts-second originally stored in capacitor 186 is now stored in both capacitor 186 and 90 and because capacitor 90 is much greater in size than capacitor 186.

At the start of the second one-half cycle, capacitor 186 and 90 are partially charged. As the voltage of the inverter rises, the voltage polarity of capacitor 186 will reverse as current flows through diode 188 and capacitor 90. Near the middle of the second one-half cycle, the AC inverter voltage will have reached its peak and also at this time, the sum of the voltages of capacitors 186 and 90 will equal the AC peak inverter voltage. If the voltage of capacity 186 exceeds that of capacitor 90, capacitor 186 will discharge through diode 188 into capacitor 90 as the voltage of the inverter decays. However, if the voltage of capacitor 90, neglecting rectifier and winding voltage drops is equal to or greater than that of capacitor 186, capacitor 186 will no longer charge capacitor 90 when the voltage of the inverter decays. This first mode of operation which occurs up until the time when the capacitor 90 charge voltage is equal to the peak AC inverter voltage is not common to conventional voltage doubler circuits. Also, during the first mode of operation in order to operate correctly, capacitor 186 cannot be an electrolitic capacitor since it must still store plus or minus charges of both polarities.

In the second mode of operation, capacitor 186 functions as in conventional voltage doubling circuits. Capacitor 186 is charged to the peak AC voltage during one-half cycle and then holds that charge until the next one-half cycle until the AC winding polarity reverses. Then the winding voltage plus the capacitor 186 voltage add together to move a charge into capacitor 90. Observing that during the first mode of operation, capacitor 186 has a peak-to-peak AC voltage a little less than two times the peak AC inverter voltage, in the second mode of operation capacitor 186 will be charged with only a DC voltage. At the start of the second mode, this DC voltage will have a peak-to-peak ripple voltage equal to the peak DC voltage. As the charge in capacitor 90 increases, the amplitude of the ripple voltage on capacitor 186 will decrease. When capacitor 90 is fully charged, capacitor 186 will have an average DC voltage approximately equal to the peak AC inverter output voltage with very little ripple.

In a specific embodiment of the circuit of FIG. 10, capacitor 186 is a 0.047 to 0.33 mfd, 400 volt, AC capacitor, and diodes 188, 190 are 1 amp, 1N5059A, or equivalent.

Figure 11:
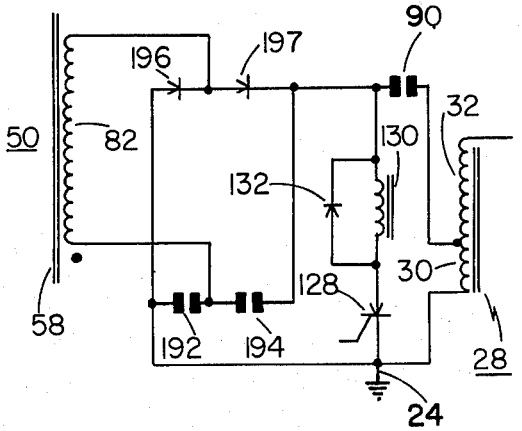
FIG. 11 is a fragmentary schematic illustration showing another voltage doubler power supply usable in the system of my invention.

Referring now to FIG. 11, there is shown another voltage doubler circuit which may substituted for bridge rectifier circuit 80 of FIG. 1. Here, capacitors 192, 194 are the voltage doubler capacitors and are of equal size. For high speed operation, the sizes of capacitors 192, 194 are chosen to give maximum full load output without overloading the inverter 50. The sizes of capacitors 192, 194 may range from 2 to 15 percent of the size of power capacitor 90.

The circuit of FIG. 11 also has two modes of operation. The first mode appears during the time that capacitor 90 has a DC terminal voltage of zero to the time that it has a voltage equal to the peak AC inverter secondary winding voltage. The second mode occurs during the time from the end of the first mode to the time when capacitor 90 reaches steady state or its full charge condition. Capacitors 192, 194 must be AC capacitors to function properly in the first mode. The oscillation of inverter 50 continues when SCR 128 is turned-on. When SCR 128 turns-off, the inverter will be able immediately to supply full load output to capacitor 90.

As ignition key switch 26 is turned-on, capacitors 90, 192, 194 have zero charge. During the first one-half cycle, assuming the polarity of winding 82 is such that diode 197 is conducting as the voltage is rising in secondary winding 82, while the voltage is increasing the voltage of capacitor 194 will be the same as the secondary winding voltage neglecting the voltage drop of diode 197 and the winding. The sum of the voltages of capacitors 192 and 90 will be the same as capacitor 194 since they are in series and in parallel with capacitor 194. After the inverter voltage has passed its peak, diode 197 will turn-off and diode 196 will turn-on allowing capacitor 194 to move some of its charge into capacitor 90 through secondary winding 82. At the same time, capacitor 192 will begin discharging through diode 196 and secondary winding 82. When the secondary winding voltage reaches zero, capacitor 192 will have discharged to about 0.65 volts, the turn-on voltage of diode 196, and the voltages of capacitor 194 minus capacitor 192 will equal the voltage across capacitor 90. At the beginning of the first part of the second one-half cycle, as the winding voltage increases, diode 196 will be turned-on and the voltage of capacitor 192 will equal the AC peak winding voltage, neglecting the rectifier and winding voltage drops, during the time the voltage is rising in winding 82.

Since capacitors 194 and 90 are in series and also in parallel with capacitor 192, the sum of the voltage of capacitors 194 and 90 will equal the voltage on capacitor 192. After the AC winding peak voltage has been reached, it will start to decrease and diode 196 will turn-off and diode 197 will turn-on. Capacitor 192 will begin to increase the charge of capacitor 90 through diode 197 and secondary winding 82. Simultaneously, capacitor 194 will discharge itself through secondary winding 82 and diode 197.

At the end of the second one-half cycle, capacitor 194 will remain charged to 0.65 volts or to the turn-on voltage across diode 197. The sum of the voltages of capacitors 192 and 194 will equal the voltage of capacitor 90 since capacitors 192 and 194 are in series and parallel with capacitor 90. It will be observed that there is an AC voltage on capacitors 192, 194 in the first mode of operation, and that there will be only a DC voltage on capacitors 192, 194 in the second mode of operation.

The second mode of operation begins after capacitor 90 reaches one-half of its final voltage level or when it reaches a voltage level equal to the peak AC inverter winding voltage. At the start of the second mode of operation, the peak-to-peak ripple voltage on capacitors 192, 194 equals approximately the peak inverter voltage. As the voltage of capacitor 90 increases above its one-half full load value, the ripple voltage of capacitors 192, 194 decreases. At steady state or when capacitor 90 has reached its final voltage, the remaining ripple on capacitors 90, 192 and 194 is a result of the bleeder load across capacitor 90. At steady state, the sum of the average dc voltages of capacitor 192 plus 194 will equal the average DC voltage of capacitor 90.

In a specific embodiment, capacitors 192, 194 are 0.047 to 0.33 mfd, 400 volt AC capacitors and diodes 196, 197 are 1 amp, 1N5059A or equivalent.

It will be seen that the capacitor discharge ignition system of the invention may be used with either a positive or negative-grounded chassis and, by the use of three switches can be operated in seven different modes, six using capacitor discharge and one using the Kettering system. Three of the six capacitor discharge modes are capable of high engine speed, while the other three are for lower or limited engine speed. Of the three capacitor discharge modes for high speed, one is used for obtaining an AC output for the spark plugs and the other two are for obtaining DC outputs. Of these two DC outputs, one is for a spark of short duration while the other is for a spark of longer duration. Of the remaining three modes of the six capacitor discharge modes which are for use at low or limited engine speed, one is for obtaining an AC output for the spark plug and two are for obtaining a DC output. One of the DC outputs is for a spark of short duration while the other DC output is for a longer spark duration.

It will be readily apparent that either or both of the two switches (84, 112) for changing the six capacitor discharge modes may be omitted.

The system of the invention includes a DC to AC inverter for raising the battery voltage to a high peak alternating current voltage which is rectified and used for charging power capacitor 90, which is discharged through primary winding section 30 of ignition coil 28 by suitable gate means, such as silicon controlled rectifier 128, at the time the breaker contacts 38 open.

The system further includes a full-wave rectifier circuit for changing the AC inverter output voltage to DC and which has a small capacitor 74 effectively connected in series with the power capacitor 90 during charging for the purpose of accomplishing continuous inverter oscillation in an ignition system with the engine running at high RPM.

The system further includes a clamp diode 116 which may be switched out of or into the circuit by switch 112 in either a biased or unbiased mode for changing the AC spark output to DC.

In accordance with an important aspect of the invention, the system includes a power ringing capacitor 108 connected in parallel with primary winding section 30 of ignition coil 28 for the purpose of continuously surpressing misfires. Finally, the system includes a triggering circuit capable of triggering SCR 128 without misfiring under all starting and running conditions.

While there have been described above the principles of this invention in connection with specific apparatus, it is to be clearly understood that this description is made only by way of example and not as a limitation to the scope of the invention.

What is claimed is:

1. In a capacitor discharge ignition system comprising an ignition transformer having a low voltage primary winding and a high voltage secondary winding adapted to be coupled in sequence at predetermined times to a plurality of spark devices, means for generating a pulse at said predetermined times, a source of direct current potential, an AC power capacitor coupled in series with said primary winding across said source and being charged thereby, gate means for short-circuiting said source in response to a control signal whereby said power capacitor discharges through said primary winding, and control means for providing a said control signal in response to each said pulse; the improvement comprising an AC ringing capacitor directly connected across said primary winding and proportioned to provide a damped oscillatory current therein when said gate means removes said short circuit thereby clamping the peak induced voltage in said secondary winding to a low predetermined value to inhibit misfiring;

said direct current source including a DC to AC inverter having an output circuit, and a full-wave rectifier coupled to said output circuit, and further comprising another AC capacitor smaller than said power capacitor series-connected with said rectifier in said output circuit for inhibiting stopping of the oscillation of said inverter by said gate means being turned ON.

2. The system of claim 1 further comprising switch means for selectively short-circuiting said other capacitor.

3. The system of claim 1 wherein said full-wave rectifier is coupled in a full-wave voltage doubler circuit.

4. The system of claim 1 wherein said pulse generating means includes breaker contacts adapted to be opened at said predetermined times, said gate means comprising a silicon-controlled rectifier having a gate circuit, said control means including a filtered, isolated and unidirectional trigger pulse circuit for providing a turn-on pulse for said gate circuit and rendering the same insensitive to false triggering, said trigger pulse circuit including a diode and first and second resistors series-connected with said breaker contacts across another source of direct current potential, a DC electrolytic capacitor connected in parallel across said contacts and the one of said resistors adjacent thereto, and means for coupling said contacts across said gate circuit.

5. The system of claim 1 wherein said pulse generating means includes breaker contacts adapted to be opened at said predetermined times, said gate means comprising a silicon-controlled rectifier having a gate circuit, another rectifier coupled to said first-named source, said control means including a filtered, unidirectional trigger pulse circuit for providing a turn-on pulse for said gate circuit and rendering the same insensitive to false triggering, said trigger pulse circuit including an electrolytic capacitor connected across the output of said other rectifier, a series dropping resistor series-connected with said breaker contacts across said capacitor, and means for coupling said contacts across said gate circuit.

6. The system of claim 1 wherein said pulse generating means includes breaker contacts adapted to be opened at said predetermined times, said gate means comprising a silicon-controlled rectifier having a gate circuit, said control means including a trigger pulse circuit for providing a turn-on pulse for said gate circuit and rendering the same insensitive to false triggering, said trigger pulse circuit including a first diode, a resistor, and the primary winding of a transformer series connected with said breaker contacts across another source of direct current potential, a second diode coupled across said primary winding and polarized in the same direction as said first diode, and a third diode connected in parallel across said contacts and said primary winding and polarized oppositely from said first and second diodes, and means for coupling the secondary winding of said transformer across said gate circuit.

7. In a capacitor discharge ignition system comprising an ignition transformer having a low voltage primary winding and a high voltage secondary winding adapted to be coupled in sequence at predetermined times to a plurality of spark devices, means for generating a pulse at said predetermined times, a source of direct current potential, an AC power capacitor coupled in series with said primary winding across said source and being charged thereby, gate means for short-circuiting said source in response to a control signal whereby said power capacitor discharges through said primary winding, and control means for providing a said control signal in response to each said pulse; the improvement comprising an AC ringing capacitor directly connected across said primary winding and proportioned to provide a damped oscillatory current therein when said gate means removes said short circuit thereby clamping the peak induced voltage in said secondary winding to a low predetermined value to inhibit misfiring; a clamp diode coupling the midpoint between said power capacitor and primary winding to a source of reference potential lower than said first-named source, said diode being polarized for current flow toward said reference and cooperating with said ringing capacitor to provide a DC high voltage spark at said device; and switch means for selectively disconnecting said diode from said reference source.

8. The system of claim 7 wherein said switch means is adapted selectively to couple said diode to a second source of reference potential higher than said first reference source.

9. In a capacitor discharge ignition system comprising an ignition transformer having a low voltage primary winding and a high voltage secondary winding adapted to be coupled in sequence at predetermined times to a plurality of spark devices, means for generating a pulse at said predetermined times, a source of direct current potential, an AC power capacitor coupled in series with said primary winding across said source and being charged thereby, gate means for short-circuiting said source in response to a control signal whereby said power capacitor discharges through said primary winding, and control means for providing a said control signal in response to each said pulse; the improvement comprising an AC ringing capacitor directly connected across said primary winding and proportioned to provide a damped oscillatory current therein when said gate means removes said short circuit thereby clamping the peak induced voltage in said secondary winding to a low predetermined value to inhibit misfiring; said direct current source including a DC to AC inverter having an output circuit, and a rectifier coupled to said output circuit, and further comprising another AC capacitor smaller than said power capacitor series-connected in said output circuit for inhibiting stopping of the oscillation of said inverter by said gate means being turned ON; switch means for selectively short-circuiting said other capacitor; a diode coupled to the midpoint between said power capacitor and primary winding, second switch means for selectively coupling said diode to first and second sources of reference potential both lower than said first-named source and one lower than the other, said diode being polarized for current flow toward said reference sources thereby to provide a DC high voltage spark at said device, said second switch means being adapted selectively to disconnect said diode from said reference sources, and third switch means for selectively disconnecting said power capacitor from said primary winding and for coupling the same and said contacts in series across another source of direct current potential thereby alternatively to provide a Kettering ignition system.

10. In a capacitor discharge ignition system comprising an ignition transformer having a low voltage primary winding and a high voltage secondary winding adapted to be coupled in sequence at predetermined times to a plurality of spark devices, means for generating a pulse at said predetermined times, a source of direct current potential, an AC power capacitor coupled in series with said primary winding across said source and being charged thereby, gate means for short-circuiting said source in response to a control signal whereby said power capacitor discharge through said primary winding, and control means for providing a said control signal in response to each said pulse; the improvement comprising an AC ringing capacitor directly connected across said primary winding and proportioned to provide a damped oscillatory current therein when said gate means removes said short circuit thereby clamping the peak induced voltage in said secondary winding to a low predetermined value to inhibit misfiring; said pulse generating means including breaker contacts adapted to be opened at said predetermined times, said control means comprising a clamping circuit for providing a turn-on pulse for said gate means at only one predetermined instant in response to opening said breaker contacts, said clamping circuit including an inductor having a winding coupled in series with said breaker contacts across another source of direct current potential, and a bi-directional clamp comprising two oppositely polarized diodes connected in parallel across said inductor winding and said breaker contacts, and means coupling said clamping circuit to said gate means for applying said pulses thereto.

11. The system of claim 10 further comprising a third capacitor coupled across said breaker contacts, said ringing and third capacitors having generally the same capacitance.

12. The system of claim 11 wherein said diodes are zener diodes coupled in circuit with said inductor winding for limiting the flux density of said inductive element and for discharging said third capacitor after said control signal is terminated and before said contacts close.

13. The system of claim 10 further comprising time delay means coupled in parallel across said contacts, said contacts when closed short-circuiting said time delay means whereby said pulse is provided in response to opening said contacts.

14. In a capacitor discharge ignition system comprising an ignition transformer having a low voltage primary winding and a high voltage secondary winding adapted to be coupled in sequence at predetermined times to a plurality of spark devices, means for generating a pulse at said predetermined times, a source of direct current potential, an AC power capacitor coupled in series with said primary winding across said source and being charged thereby, gate means for short-circuiting said source in response to a control signal whereby said power capacitor discharges through said primary winding, and control means for providing a said control signal in response to each said pulse; the improvement comprising an AC ringing capacitor directly connected across said primary winding and proportioned to provide a damped oscillatory current therein when said gate means removes said short circuit thereby clamping the peak induced voltage in said secondary winding to a low predetermined value to inhibit misfiring;

a clamp diode coupling the midpoint between said power capacitor and primary winding to a source of reference potential lower than said first-named source, said diode being polarized for current flow toward said reference source and cooperating with said ringing capacitor to provide a DC high voltage spark at said device.

* * * * *

UNITED STATES PATENT AND TRADEMARK OFFICE

CERTIFICATE OF CORRECTION

PATENT NO. : 4,136,659

DATED : January 30, 1979

INVENTOR(S) : Harold J. Smith

It is certified that error appears in the above-identified patent and that said Letters Patent are hereby corrected as shown below:

Col. 1, line 37, "speed" should be -- speeds --.
Col. 2, line 3, "normally-fired" should be -- normally fired --.
Col. 3, line 19, insert -- is coupled -- after "capacitor".
Col. 3, line 61, insert -- the -- before "circuit".
Col. 6, line 38, insert -- will be longer -- after "duration".
Col. 6, line 61, "is" should be -- it --.
Col. 7, line 33, "a" should be -- as --.
Col. 7, line 68, "1N5062" should be -- 1N5062A --.
Col. 9, line 38, after "life" and before the ".", add -- ,however, the point contact resistance must be low --.
Col. 10, line 21, change "158" to -- 156 --.
Col. 11, line 36, after "desirable" and before the ".", insert --to keep the point contacts clean, when high surface contact resistance may otherwise develop --.
Col. 12, line 35, "1N5059A" should be -- 1N5062A --.
Col. 12, line 46, "thos" should be -- those --.
Col. 14, line 58, "90" should be -- 190 --.
Col. 15, lines 14-22, delete " If the voltage of capacity 186 exceeds that of capacitor 90, capacitor 186 will discharge through diode 188 into capacitor 90 as the voltage of the inverter decays. However, if the voltage of capacitor 90, neglecting rectifier and winding voltage drops is equal to or greater than that of capacitor 186, capacitor 186 will no longer charge capacitor 90 when the voltage of the inverter decays." and insert -- Capacitor 186 will then discharge to the turn-on voltage of diode 190 through diode 190 and the inverter winding as the voltage in the inverter decays to zero. --

UNITED STATES PATENT AND TRADEMARK OFFICE

CERTIFICATE OF CORRECTION

PATENT NO. : 4,136,659

DATED : January 30, 1979

INVENTOR(S) : Harold J. Smith

It is certified that error appears in the above-identified patent and that said Letters Patent are hereby corrected as shown below:

Col. 15, line 50 "1N5059A" should be -- 1N5062A --.
Col. 16, line 66, "1N5059A" should be -- 1N5062A --.
Claim 10, Col. 20, line 5, "discharge" should be -- discharges --.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*